United States Patent [19]

Iannelli et al.

[11] Patent Number: 4,518,104

[45] Date of Patent: May 21, 1985

[54] WINE DISPENSING APPARATUS AND METHOD

[75] Inventors: Frank M. Iannelli, Spartanburg; David H. James, Roebuck, both of S.C.

[73] Assignee: Gerlach Industries, Spartanburg, S.C.

[21] Appl. No.: 458,163

[22] Filed: Jan. 14, 1983

[51] Int. Cl.[3] ..... B67D 5/62

[52] U.S. Cl. ..... 222/146.6; 222/318; 137/334; 137/599.1

[58] Field of Search ..... 222/1, 318, 146 C, 146.6; 137/599.1, 334, 337

[56] References Cited

U.S. PATENT DOCUMENTS 4,225,059 9/1980 Kappos ..... 222/146 C
4,308,975 1/1982 Bowen ..... 222/146 C X

FOREIGN PATENT DOCUMENTS 2802142 9/1978 Fed. Rep. of Germany ..... 137/337
891881 3/1962 United Kingdom ..... 222/146 C

*Primary Examiner*—Charles A. Marmor
*Attorney, Agent, or Firm*—Dority & Manning

[57] ABSTRACT

A method and apparatus for dispensing large numbers of wine servings at uniform temperatures is disclosed which includes a source (14) of wine at room temperature connected to a refrigeration unit (16). A wine dispensing valve (18) is connected to the refrigeration unit (16) for dispensing wine. A wine metering and mixing valve (A) is connected between a delivery line (20) and a dispensing line (22) to bypass a metered amount of room temperature wine from the delivery line to the dispensing line and thus raise the temperature of the wine to a desired wine serving temperature prior to serving.

2 Claims, 2 Drawing Figures

WINE DISPENSING APPARATUS AND METHOD

BACKGROUND OF THE INVENTION

With the increasing popularity of wine as a dinner drink, the problem of automatically dispensing wine in a large number of servings such as in a restaurant operation at uniform wine serving temperatures, is a problem to which considerable attention need be given. In restaurant operations, a large number of servings of wine may be dispensed over a very short period of time during peak demand. Alternately, only a very few servings may be needed over periods of lesser demand. However, it is desirable that the wine be served at a desirable wine serving temperature regardless of the time interval over which it is dispensed.

Heretofore, wine has been served mainly from a bottle or from a large container into an individual serving container such as a wine glass. Small barrels, plastic bags in boxes, and other containers have been utilized to dispense wine by means of an on-off valve. However, a serving temperature of between forty and fifty degrees (F.) is best for the serving and drinking of most wines.

Refrigerated systems without sophisticated controls reduce the wine to a temperature which is too cold for serving. Elaborate and expensive controls for the refrigeration unit would be required to dispense wine chilled only to a proper wine serving temperature in the range of forty to fifty degrees (F.). If wine is left in a refrigerated system without controls for a sufficient period of time and not drawn out, it will reach a refrigerated temperature of 32 to 34 degrees (F.). This is too cold for the wine to be served at its best drinking temperature for taste.

To provide the controls necessary for chilling the wine in the refrigeration system to a temperature range of 42 to 48 degrees (F.) would render the apparatus too costly and complicated for the purposes herein.

Accordingly, an important object of the present invention is to provide simplified apparatus for automatically dispensing wine at a predetermined wine serving temperature.

Still another important object of the present invention is to provide apparatus and method for dispensing wine at a predetermined wine serving temperature which does not require elaborate control of the refrigeration system.

Still another important object of the present invention is to provide apparatus and a method for dispensing wine at uniform wine serving temperatures in a restaurant and the like commercial operation in which a large number of servings of wine are dispensed over both short and long periods of time.

Still another important object of the present invention is to provide apparatus and method for dispensing wine wherein a metered amount of room temperature wine is mixed with refrigerated wine in response to the opening of a wine dispensing valve to dispense wine at predetermined uniform wine serving temperatures regardless of the number of servings or length of the time period during which the servings are dispensed.

SUMMARY OF THE INVENTION

The above objectives are accomplished according to the present invention by means of apparatus and method which includes a portable cabinet which contains a wine source and a refrigeration unit which are connected to a wine dispensing valve. The wine from the wine source, which is at room temperature, and the refrigerated wine coming from the refrigeration unit both pass through a wine metering and mixing valve which bypasses a predetermined amount of the room temperature wine into the refrigerated wine in response to the dispensing valve being open. The amount of room temperature wine bypassed into the refrigerated wine is preset and metered so that wine is dispensed uniformly at desired wine serving temperatures. No matter how long the wine dispensing valve has been closed and wine is stored in the refrigeration unit, a sufficient amount of wine at room temperature is bypassed into the refrigerated wine prior to dispensing to bring the wine up to the desired wine serving temperature.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
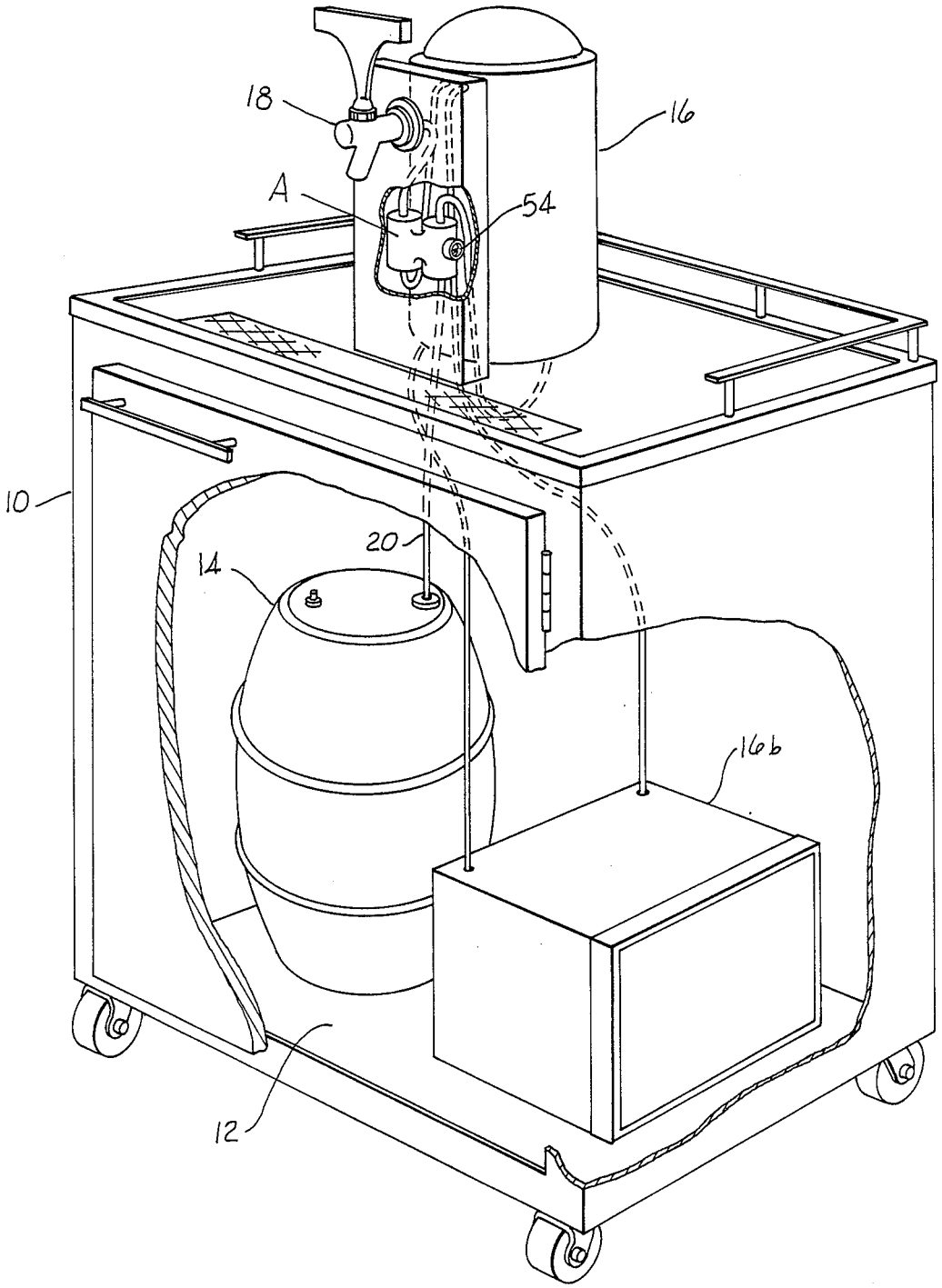
FIG. 1 is a perspective partially cut-away view illustrating wine dispensing apparatus constructed according to the present invention.
Figure 2:
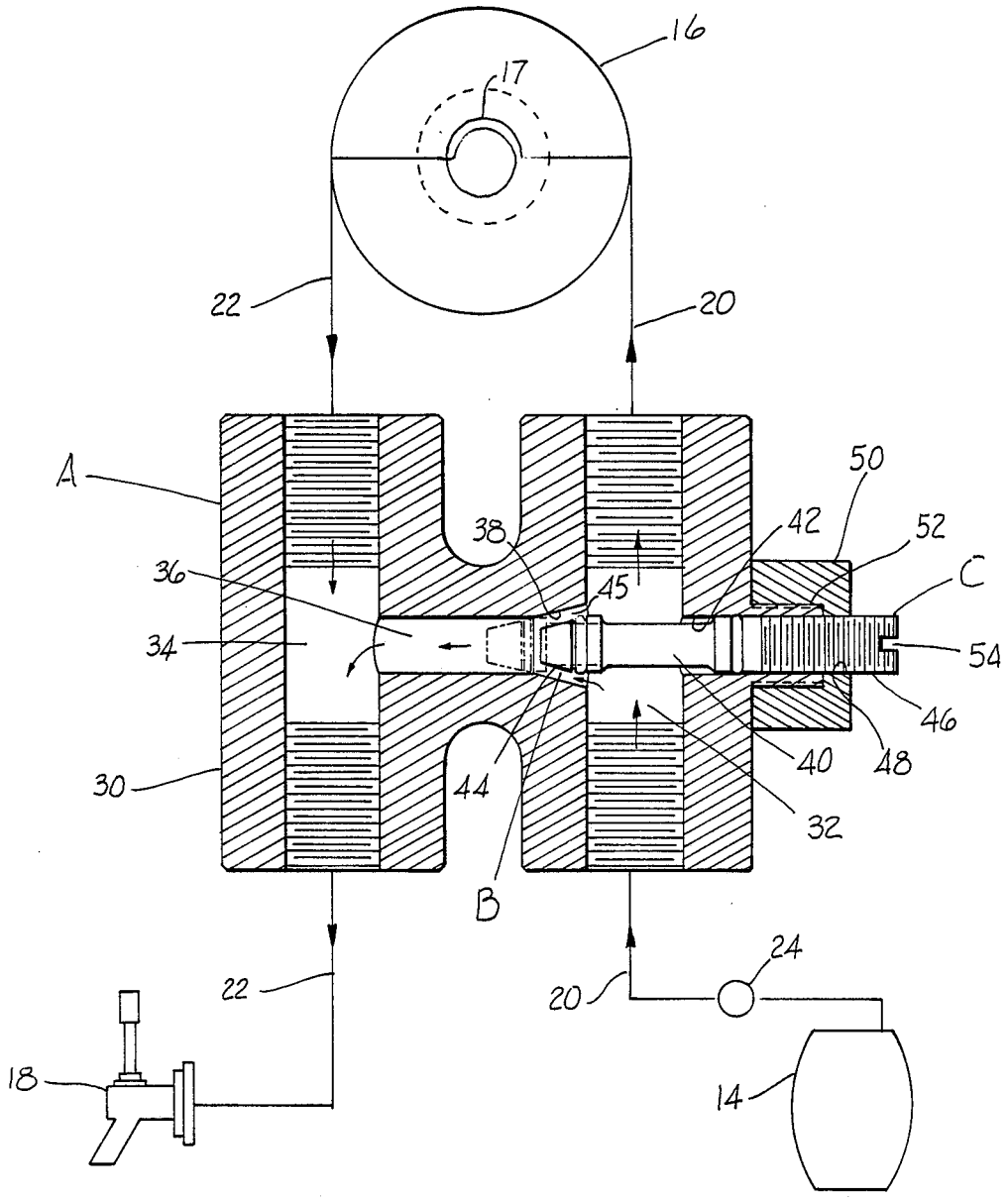
FIG. 2 is a schematic view illustrating the dispensing circuit and wine mixing valve constructed according to the present invention for dispensing wine at uniform wine serving temperatures.

Referring now in more detail to the drawings, apparatus and method is disclosed for dispensing a large or small number of wine servings at a uniform wine serving temperature during periods of varying time intervals in restaurant and the like operations. The apparatus includes a cabinet 10 having an interior chamber 12 in which a source 14 of wine may be contained at room temperature. A refrigeration unit 16 is carried on top of the cabinet which may be any suitable type of refrigeration unit such as an icebank refrigeration system such as disclosed in applicant's co-pending application Ser. No. 316,873, filed Oct. 30, 1981, entitled BEVERAGE COOLING DEVICE, which is hereby incorporated herein. The unit basically includes a refrigeration coil (not shown) connected to a compressor unit **16*b*. The refrigeration coil surrounds a container in which a water bath is contained. The refrigeration unit is operated to maintain an icebank in the container. A coil 17** is carried in the ice water bath through which the wine flows.

A wine dispensing valve 18, which may be any suitable two-way valve, is carried by the cabinet for dispensing wine into an individual serving container such as a wine glass when the valve is open. A first wine delivery line 20 is connected to the wine source 14 and the coil 17 in the refrigeration unit 16. A second wine delivery line 22 is connected between the coil 17 in the refrigeration unit and the dispensing valve 18. A pump 24 may be carried in the first wine delivery line for pumping the wine from the source 14 to the refrigeration unit.

There is a wine metering and mixing means A for mixing a metered amount of the wine from the wine source 20 with the refrigerated wine coming from the refrigeration unit 16 prior to dispensing the wine from the valve 18. The wine metering and mixing means is carried in the cabinet 10 at a suitable location. A metering means B is provided for metering the wine from the wine source 20 to be mixed with the refrigerated wine.

In a preferred embodiment, the wine metering and mixing means A includes a wine metering and mixing valve 30 carried in the wine cabinet having a housing which includes a first passage 32 connected in series in the first delivery line 20 between the wine source or pump 24 and the refrigeration unit 16. There is a second passage 34 in the wine mixing valve 30 connected in series in the second wine delivery line 22 between the refrigeration unit 16 and the wine dispensing valve 18. There is a third passage 36 in the wine mixing valve between the first passage 32 and second passage 34 which bypasses wine from the first passage to the second passage bypassing the refrigeration unit 16.

There is an entrance port 38 having a conical shape in the entrance end of the passage 36 which tapers outwardly and opens into the passage 32. The tapered entrance port provides a means for constricting the passage which creates a venturi effect when the dispensing valve 18 is open and refrigerated wine is drawn through the second passage 34 to draw the room temperature wine passing through passage 32 through the third passage 36. Means for metering the amount of room temperature wine passing through the bypass passage 36 includes, in addition to conical entrance port 38, a valve means C carried in the housing of the wine mixing valve.

Valve means C includes a valve stem 40 received in a bore 42 formed in the housing of the wine mixing valve. The valve stem 40 terminates at one end in a tapered valve member 44 having a taper which corresponds to that of the entrance port 38 such that the valve opening passage 45 therebetween and hence the metering of the room temperature wine through the passage may be adjusted. The opposite end of the valve stem 40 includes a threaded portion 46. The threaded portion 46 is received in a threaded bore 48 of a locking nut 50 which is fastened over a threaded flange 52 on the valve housing. A slot 54 is formed in the end of threaded portion 46 for turning the valve in the housing adjusting the metering opening accordingly. The valve means C may thus be preset such that a predetermined metered amount of room temperature wine passes through the bypass for admixing with the refrigerated wine flowing through passage 34 responsive to dispensing valve 18 opening. The opening of valve 18 causes a pressure drop across the constricted passage and flow through the bypass.

In this manner, mixing of room temperature and chilled wine is uniformly achieved and wine is dispensed at uniform wine serving temperatures regardless of the number of servings dispensed or length of time period over which dispensing occurs.

In practice, wine coming from the refrigeration unit is typically at a temperature in the range of thirty-two to thirty-six degrees (F). This is true no matter whether the wine has been standing in the refrigeration unit 16 for a long period of time or momentarily as in passing through the unit. The room temperature wine is normally at approximately seventy degrees (F.). With the valve means C preset either at the factory or at the restaurant, a sufficient and predetermined amount of wine at seventy degrees is metered and mixed with the refrigerated wine at thirty-two to thirty-six degrees (F.) to provide wine served at a desired serving temperature of forty-two to forty-eight degrees (F.).

In one application, the icebank refrigeration system was utilized, previously referred to, and a liter of wine was dispensed per minute for approximately one hour. In other words, sixty liters of wine was dispensed from the apparatus in one hour. By utilizing the metering and mixing valve method and apparatus of the present invention, the wine dispensed was found to be uniformly at temperatures between forty-two and forty-eight degrees (F.).

While a pump has been shown for delivering the wine from the wine source to the refrigeration unit, it is also contemplated that a pressurized wine source may also be utilized.

While a preferred embodiment of the invention has been described using specific terms, such description is for illustrative purposes only, and it is to be understood that changes and variations may be made without departing from the spirit or scope of the following claims.

What is claimed is:

1. Apparatus for dispensing large numbers of wine servings at a uniform wine serving temperature during varying cycles of time such as in restaurant operations and the like comprising:

a cabinet having an interior chamber for storing a source of wine at room temperature;

a refrigeration unit carried by said cabinet through which said wine is delivered for refrigerating and lowering the temperature of said wine;

a wine dispensing valve carried by said cabinet for dispensing wine into a serving container when said valve is open;

a first wine delivery line for conveying said wine from said source to said refrigeration unit;

a second wine delivery line for conveying wine from said refrigeration unit to said dispensing valve;

a wine mixing valve carried in said cabinet having a first passage serially connected in said first delivery line between said wine source and said refrigeration unit and a second passage serially connected in said second delivery line between said refrigeration unit and dispensing valve;

said wine mixing valve including a third valve passage connected between said first and second passages for delivering a metered amount of wine from said first passage to said second passage bypassing said refrigeration unit;

valve means carried in said third valve passage for controlling and metering the amount of wine bypassed through said third passage;

a conical entrance port provided in said third valve passage, said conical entrance port tapering outwardly and opening into said first passage for creating a venturi effect for drawing room temperature wine through said third passage in response to opening of said wine dispensing valve and flow of refrigerated wine through said second valve passage, and said valve means including a manually operable valve stem threadably carried by said wine mixing valve having a tapered valve member corresponding to the taper of said entrance port for closing and opening said entrance port in varying amount.

2. The apparatus of claim 1 including means for setting said valve stem in a desired pre-set position thus predetermining the amount of said room temperature wine bypassed into said second delivery line and mixed with said refrigerated wine.

* * * * *